US005502977A

United States Patent [19]

Ziesel et al.

[11] Patent Number: 5,502,977

[45] Date of Patent: Apr. 2, 1996

[54] ICE BANK PROBE ASSEMBLY FOR ACCOMMODATING REPAIR

[75] Inventors: Lawrence B. Ziesel, Marietta, Ga.; Brian C. Jones, Collinsville; Peter Currier, Winsted, both of Conn.

[73] Assignee: The Coca-Cola Company, Atlanta, Ga.

[21] Appl. No.: 360,002

[22] Filed: Dec. 20, 1994

[51] Int. Cl.[6] ..... F25C 1/12

[52] U.S. Cl. ..... 62/139; 62/59; 374/208

[58] Field of Search ..... 374/208; 248/61, 248/68.1, 225.1, 225.2; 403/103, 104; 285/133.1, 138; 62/59, 139

[56] References Cited

U.S. PATENT DOCUMENTS

| | | | |
|---|---|---|---|
| 1,823,106 | 9/1931 | King | 62/139 |
| 2,921,825 | 1/1960 | Spiegel | 403/103 X |
| 3,422,634 | 7/1967 | Brown | 62/390 |
| 3,788,090 | 1/1974 | Richards | 62/139 |
| 3,892,335 | 7/1975 | Schroeder | 222/129.1 |
| 4,025,207 | 5/1977 | Johnson, Jr. | 403/103 X |
| 4,497,179 | 2/1985 | Iwans | 62/59 |
| 4,626,643 | 12/1986 | Minet | 374/208 X |
| 4,813,639 | 3/1989 | Midkiff et al. | 248/68.1 |
| 4,832,298 | 5/1989 | Metcalf | 248/225.2 X |
| 4,881,824 | 11/1989 | Falk et al. | 374/208 X |
| 4,934,150 | 6/1990 | Fessler | 62/59 |
| 5,348,395 | 9/1994 | Corr, II et al. | 374/208 X |
| 5,360,269 | 11/1994 | Ogawa et al. | 374/208 X |

*Primary Examiner*—William E. Tapolcai

[57] ABSTRACT

A removable ice bank probe assembly includes a guide tube mounted through an opening in the deck of a refrigeration unit and secured to an evaporator coil of the unit disposed within a water bath of a post-mix beverage dispenser. The removable assembly also includes an elongated rod for supporting an ice bank probe at a bottom end thereof and a transverse arm at the top end thereof which fits in a key slot in the top of the guide tube in order to accurately align the probe assembly within the refrigeration unit. The upper transverse arm may be gripped by the fingers of an operator to quickly remove the probe when repair or servicing is needed. The probe may then be easily reinserted into the guide tube and positioned via the transverse arm and slot in a proper alignment with respect to the evaporator coils which form the ice bank which it monitors. In addition, an ice bank probe protection bracket includes a wire form cage which surrounds the ice bank probe secured to the evaporator coils of a removable refrigeration unit in order to protect the ice bank probe during servicing of the refrigeration unit.

10 Claims, 4 Drawing Sheets

ICE BANK PROBE ASSEMBLY FOR ACCOMMODATING REPAIR

BACKGROUND OF THE INVENTION

The present invention relates to ice bank probe assemblies for facilitating replacement or repair of the probes as required. More specifically, the present invention relates to assemblies for facilitating either removal of an ice bank probe from an associated mechanical refrigeration deck, or a protection bracket for the probe, if repair is effected through complete removal of the refrigeration deck.

In some types of post-mix beverage dispensers, the refrigeration system includes a mechanical refrigeration system which forms and ice bank in a water bath for cooling the syrup and diluent for making the beverage. The syrup and diluent pass through tubes disposed within the water bath. Such a prior art system is generally illustrated in FIG. 1 of the drawings which depicts a beverage dispenser (10) having a housing including a tank (12) and a shroud (14), a plurality of dispensing valves (not shown), a mechanical refrigeration unit (18), and an ice bank control system (20).

The refrigeration unit (18) includes a support plate (22) generally referred to as the deck, resting on the tank (12) and evaporator coils (24) that extend down below the plate (22) in order to produce an ice bank (shown in dotted lines) about the evaporator coils (24). This ice bank cools the water in the water bath (12) and the syrup and diluent in the tubes passing therethrough. The refrigeration unit (18) may also include an agitator (26), driven by an electric motor (28) for circulating the water surrounding the ice bank to cause the ice bank to release its latent heat, thereby cooling the diluent (water) and syrup tubes which are submerged in the water surrounding the ice bank. The refrigeration unit (18) also includes a compressor (19) for operating the mechanical refrigeration unit. In the dispenser illustrated in FIG. 1, the ice bank control system includes a pair of ice bank thickness sensors (32) and (34), both of which extend down through an opening in the plate or deck (22). This opening is labeled (40). The lower ends of the sensors (32) and (34) are disposed in close proximity to cooling coils (24) so they may accurately measure and monitor the thickness of the ice bank. Electrical wires (38) extend from the probe holder (36) just above deck (22) and run to appropriate ice bank control circuitry in a housing above the plate or deck (22).

As illustrated in this prior art beverage dispenser, the ice probe holder (36) is secured to the deck (22) by a screw or bolt (37) extending through an aperture in mounting bracket (39). Accordingly, when it is necessary to repair or replace the ice probe assembly, it may be simply unscrewed and removed from the aperture (40) and the refrigeration deck.

However, it is extremely important that the ice bank assembly be accurately positioned at predetermined distances with respect to coils (24) of the evaporator coil of the refrigerator system so that ice bank thickness may be accurately determined. The problem presented by the structure illustrated in the beverage dispenser (30) of FIG. 1 is that, when replacing the ice bank probe assembly, electrodes (32), (34) could easily be reinserted through the aperture (40) and be misaligned (improperly spaced) from coils (24). Furthermore, it requires unscrewing screw (37) which passes through bracket (39) which may very well have corroded and present difficulties in removal.

The beverage dispenser illustrated in FIG. 1 and described hereinbefore is fully disclosed in U.S. Pat. No. 4,497,179 to Iwans which is assigned to the same assignee as the present invention.

Another technique of repairing or replacing an ice bank probe in a beverage dispenser such as that illustrated in FIG. 1 is to simply unbolt and remove the entire refrigeration unit which includes coils (24). Such a technique is discussed in U.S. Pat. Nos. 3,422,634 to Brown and 3,892,335 to Schroeder. However, quite often when the entire refrigeration unit is removed, the very fragile ice bank probe or probes become damaged because they hit against other objects and break during removal or re-installation.

Accordingly, a need in the art exists for an easily removable ice bank probe which can be quickly and easily removed from the deck of a mechanical refrigeration unit and accurately aligned with respect to the evaporator coil in a water bath when reinstalled. In addition, there is a need in the art for an assembly for protecting an ice bank probe secured to the deck of a removable refrigeration unit, should the entire deck or the probe assembly be removed for repair or replacement.

SUMMARY OF THE INVENTION

Accordingly, it is a primary object of the present invention to provide an ice bank probe assembly which facilitates easy removal and reinsertion of the ice bank probes separate from the refrigeration deck on which it is mounted.

It is another object of the present invention to provide an ice bank probe assembly including an accurate alignment device for facilitating the proper and accurate placing of the ice bank probe upon reinsertion through the refrigeration deck following repair.

It is a further object of the present invention to provide a protection bracket for an ice bank probe secured within a refrigeration unit for a post-mix beverage dispenser, which precludes damage to the ice bank probe during removal and/or reinstallation of the complete refrigeration unit.

The objects of the invention are fulfilled by providing an ice bank probe assembly for use in a mechanical refrigeration unit of a post-mix beverage dispenser comprising:

a guide tube extending along a predetermined axis within said refrigeration unit adjacent to a evaporation coil thereon;

an elongated rod movably supportable in said guide tube, said rod having a first end manually grippable, for imparting movement thereof through the opening and a second end for supporting an ice bank probe thereon; and key means for determining a fixed orientation between said rod and said guide tube;

Additional objects of the present invention are fulfilled by providing an ice bank probe assembly wherein the key means comprises a slot in said guide tube for receiving a transverse arm extending from the first end of the rod.

Still further objects of the present invention are fulfilled by providing a mounting assembly for an ice bank probe in a mechanical refrigeration unit in a post-mix beverage dispenser, said unit including an evaporator having spaced tubular coil portions comprising:

a bracket for supporting the ice bank probe;

fastening means for securing said bracket to the spaced tubular portions; and a cage partially enclosing said ice bank probe, said cage having a first portion fastened to said one of the tubular portions and overlying said bracket, and a second portion extending from the first portion to a distal end of the bracket and secured thereto.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENT

Figure 1:
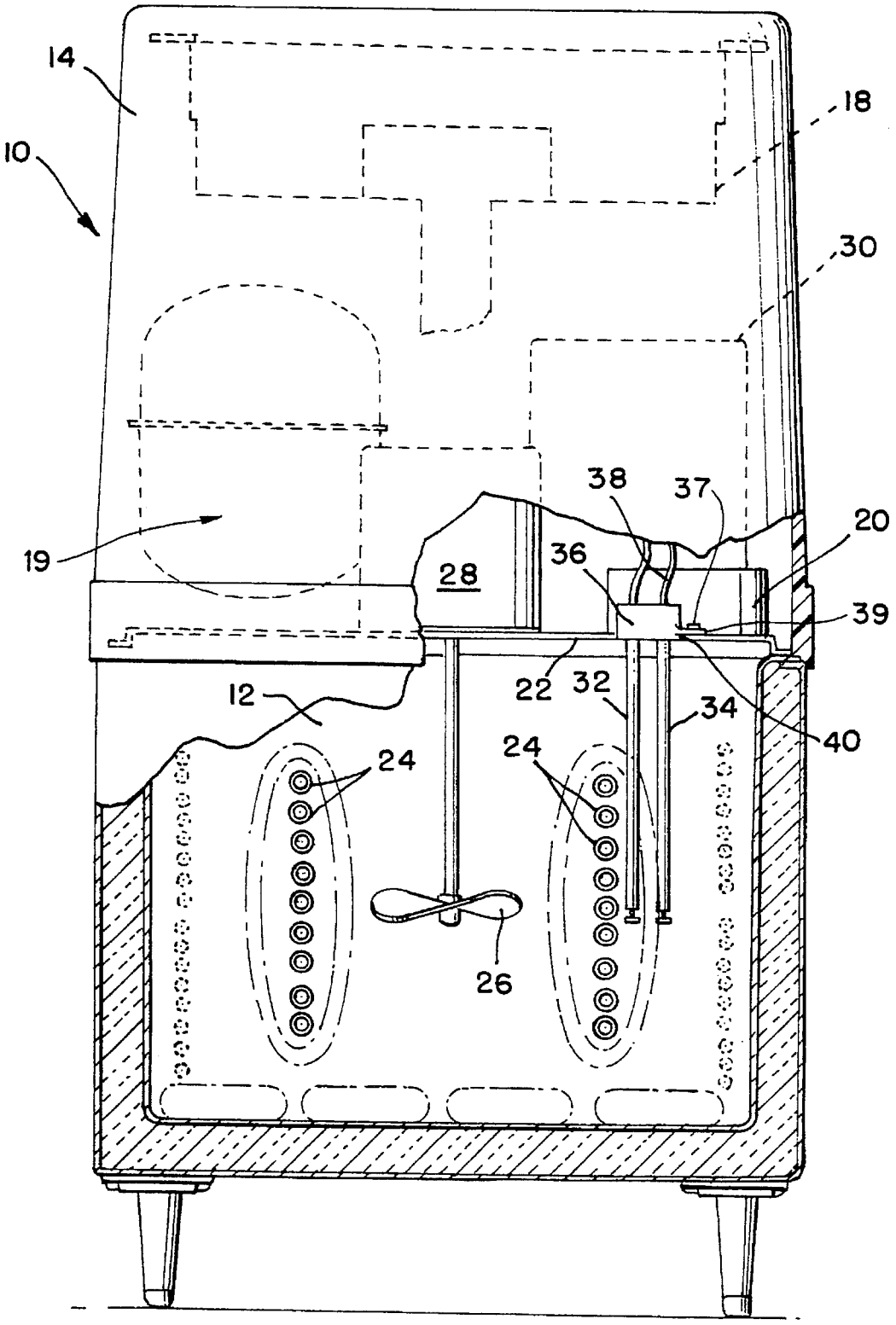
FIG. 1 (PRIOR ART)
FIG. 1 is an elevational view, partly in section, of a beverage dispenser including a water bath and mechanical refrigeration unit which is known in the prior art.
Figure 2:
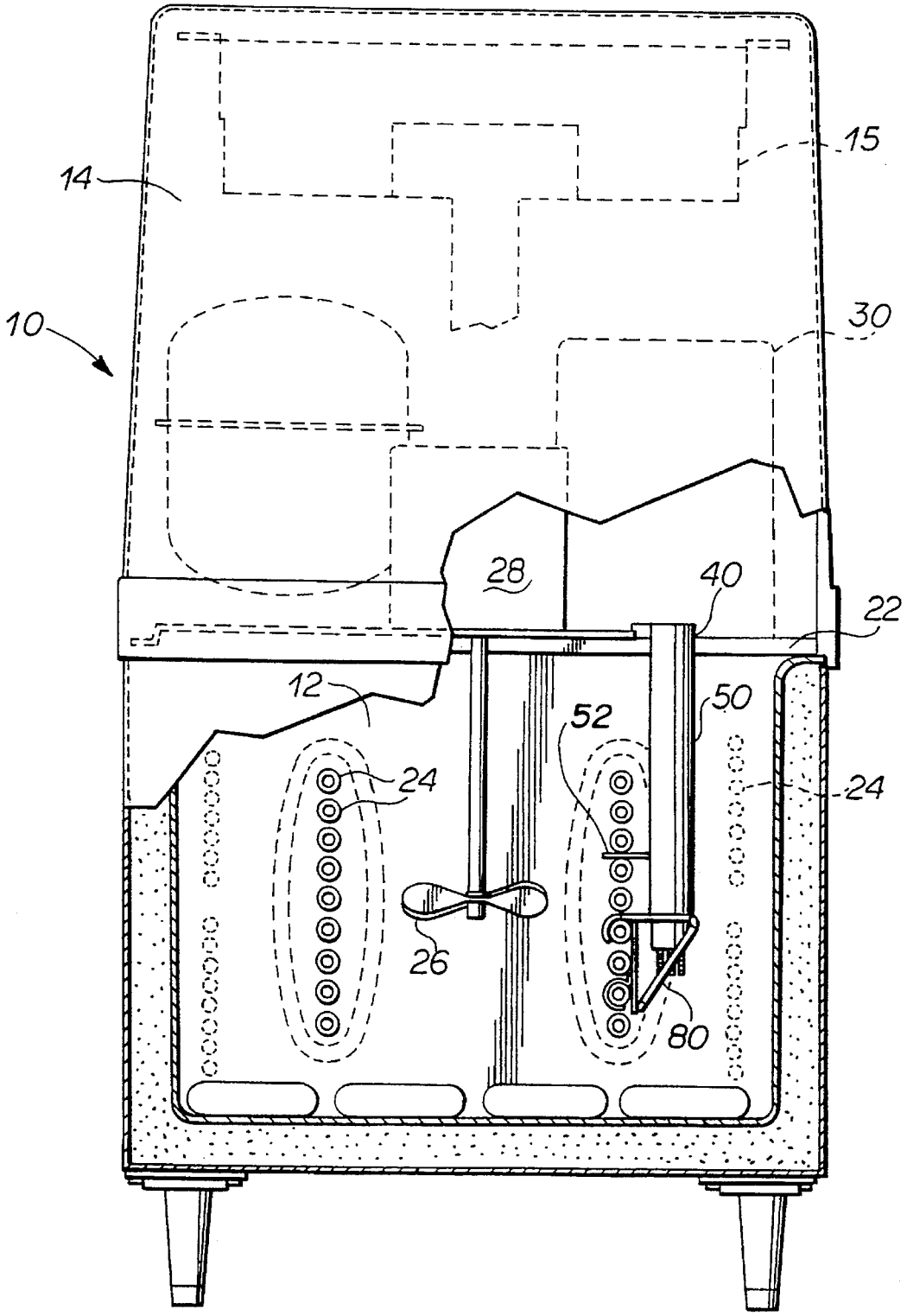
FIG. 2 illustrates the beverage dispenser of FIG. 1 with a portion of the removable ice bank probe assembly of the present invention installed therein to demonstrate the nature of the improvement of the present invention.
Figure 3:
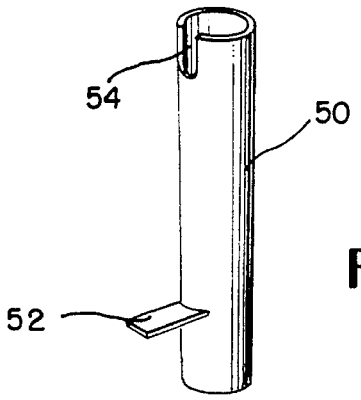
FIG. 3 is a perspective view of the guide tube of the removable ice bank probe of the present invention which is illustrated as installed in the beverage dispenser of FIG. 2.
Figure 4:
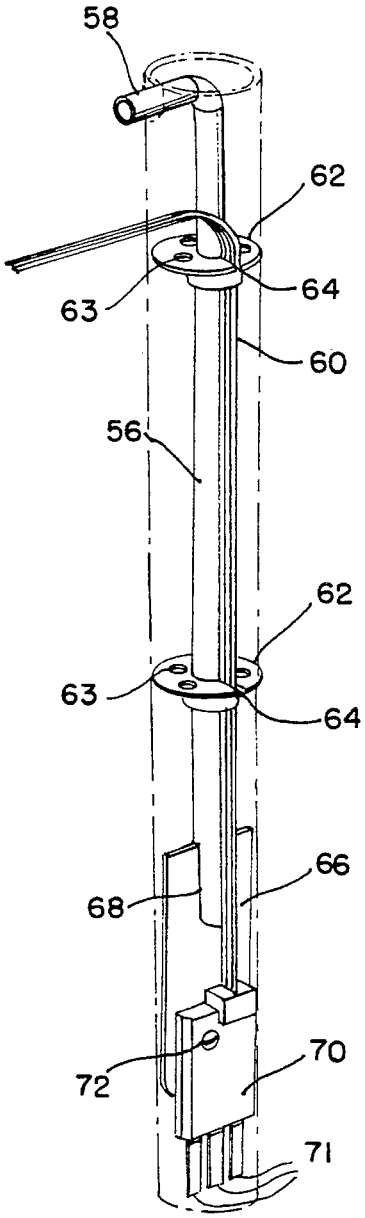
FIG. 4 is a perspective view of a portion of the ice bank probe assembly of the present invention which fits within the guide tube of FIG. 3.

Referring to FIGS. 2 and 3, there is illustrated a guide tube (50) including a transverse mounting arm (52) and a slot (54) therein. Guide tube (50) is installed through opening (40) in refrigeration deck (22) as illustrated in FIG. 2 and support arm (52) may be soldered or brazed directly to one of the evaporator coil portions (24). Accordingly, guide tube (50) is disposed in a fixed position within aperture (40) and is secured to coils (24). Therefore, when the ice bank probe assembly of FIG. 4 is inserted, the ice bank probe per se will be accurately positioned with respect to the evaporator coils (24). Since the ice bank grows from the evaporator coils (24), this results in superior ice bank control. A protective bracket assembly (80) may also be provided. Details of bracket assembly (80) will be discussed hereinafter with reference to FIG. 5.

The remainder of the ice bank probe assembly is illustrated in the perspective view of FIG. 4. As illustrated therein, this assembly includes an elongated rod (56) and a transverse arm (58) extending from a top end thereof. The arm (58) is provided for manual manipulation by an operator for insertion and removal of the ice bank probe. The arm (58) also fits within the slot (54) in the top of guide tube (50) to key the rod and guide tube together to assure proper alignment of the ice bank probe assembly.

On the lower end of rod (56), there is provided a mounting plate (66) which fits within a slot (68) in the bottom of rod (56). The ice bank probe per se (70) is secured by a screw (72) to the mounting plate (66). An electrical cable or wire (60) are connected to the probe (70) and run up and parallel to the rod (56) through slots (64) in rod positioning discs (62). Holes (63) may be parallel in discs (62) so that hot water may be poured down through tube to (50) to melt ice around the probe. The upper end of cable (60) is connected to appropriate ice bank control circuitry (not shown). The diameters of discs (62) are slightly less than the inside diameter of guide tube (50) so that a sliding fit is provided. Guide tube (50) is shown in dotted lines in FIG. 4 in order to illustrate its relative size and how it removably supports rod (56) and the other components of the ice bank assembly. The ice bank probe (70) has a plurality of electrodes (71) extending from the bottom thereof to sense the thickness of the ice bank in a manner known in the art.

Figure 5:
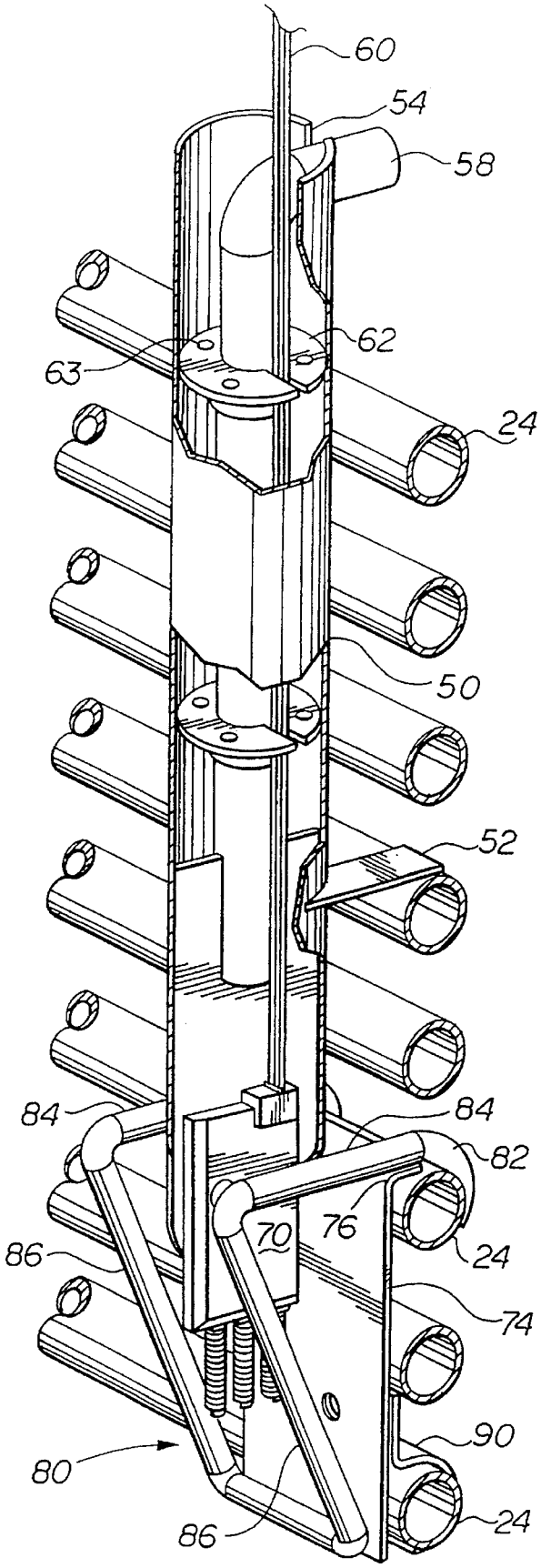
FIG. 5 is a perspective view illustrating the ice bank probe protection bracket of the present invention.

Referring to FIG. 5, there is illustrated in perspective the ice bank probe protection bracket assembly (80) of the present invention in combination with the ice bank probe assembly of FIG. 4. This bracket assembly is preferably formed from wire portions including a pair of parallel upper portions (84) connected to evaporator coil (24) through curved retaining arms (82). A pair of parallel downwardly depending arms (86) extend from arms (84) and are fastened to the bottom of a bracket (74). Arms (86) are connected together by a transverse arm (88) in order to strengthen the bracket assembly.

Bracket (74) includes a vertically disposed plate with a horizontal arm (76) at the top thereof. The bottom of plate (74) is connected to the next adjacent coil portion (24) by one or more clips (90). Bracket assembly (80) protects ice bank probe (70) from damage during removal and insertion of the associated refrigeration unit of which it is a part.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ice bank probe assembly for use in a mechanical refrigeration unit of a post-mix beverage dispenser comprising:

a guide tube extending along a predetermined axis in an opening within said refrigeration unit adjacent to a evaporator coil thereof;

an elongated rod movably supportable in said guide tube, said rod having a first end for imparting movement thereof through the opening and a second end for supporting an ice bank probe thereon; and key means for determining a fixed orientation between said rod and said guide tube.

2. The ice bank probe assembly of claim 1 further including an electrical cable extending along said rod between the first and second ends thereof, said cable being connected to said ice bank probe; and at least one cable guide coupled to said rod and having a slot for supporting the cable therein.

3. The ice probe assembly of claim 1 wherein the first end of the rod has a transverse arm for manual gripping by an operator.

4. The ice bank probe assembly of claim 3 wherein said key means comprises a slot in said guide tube for receiving said transverse arm.

5. The ice bank probe assembly of claim 1 wherein said ice bank probe is mounted on a support plate, and the second end of the rod has a slot for receiving said support plate.

6. The ice bank probe assembly of claim 1 further comprising:

a bracket for supporting the ice bank probe;

fastening means for securing the second leg of said bracket to the spaced tubular portions; and a cage partially enclosing said ice bank probe, said cage having a first portion fastened to said one of the tubular portions and overlying said, and a second portion extending from the first portion to a distal end of the bracket and secured thereto.

7. The ice bank probe assembly of claim 6 wherein said cage is formed from spaced wire portions.

8. An ice bank probe assembly for use in a mechanical refrigeration unit of a post-mix beverage dispenser comprising:

an elongated rod movably supportable in an opening in the mechanical refrigeration unit, said rod having a first end to be gripped for imparting movement thereof through the opening and a second end for supporting an ice bank probe thereon;

an electrical cable extending along said rod between the first and second ends thereof, said cable being connected to said ice bank probe; and at least one cable guide coupled to said rod and having a slot for supporting the cable therein.

9. The ice probe assembly of claim 8 wherein the first end of the rod has a transverse arm for gripping by an operator.

10. The ice bank probe assembly of claim 8 wherein said ice bank probe is mounted on a support plate, and the second end of the rod has a slot for receiving said support plate.

* * * * *